US012408762B1

(12) United States Patent
Li

(10) Patent No.: US 12,408,762 B1
(45) Date of Patent: Sep. 9, 2025

(54) INFLATABLE BED SYSTEM WITH AUTOMATIC ROLLING UP AND UNFOLDING

(71) Applicant: Zhong Li, Huanggang (CN)

(72) Inventor: Zhong Li, Huanggang (CN)

( * ) Notice: Subject to any disclaimer, the term of this patent is extended or adjusted under 35 U.S.C. 154(b) by 0 days.

(21) Appl. No.: 18/945,509

(22) Filed: Nov. 12, 2024

(30) Foreign Application Priority Data

Mar. 6, 2024 (CN) ..... 202420429709.2
Oct. 19, 2024 (CN) ..... 202422536443.4

(51) Int. Cl.
*A47C 27/08* (2006.01)

(52) U.S. Cl.
CPC ..... *A47C 27/082* (2013.01); *A47C 27/088* (2013.01)

(58) Field of Classification Search
CPC .... A47C 27/082; A47C 27/084; A47C 27/088
USPC ..... 5/706
See application file for complete search history.

(56) References Cited

U.S. PATENT DOCUMENTS 2,372,218 A * 3/1945 Manson ..... A47C 27/081 92/92
3,016,317 A * 1/1962 Brunner ..... B32B 27/00 428/167
3,222,697 A * 12/1965 Scheermesser ..... A47C 27/15 5/636
3,935,690 A * 2/1976 Lea ..... B65B 63/028 53/430
4,451,240 A * 5/1984 Wood ..... A47C 27/146 5/652.1
5,705,252 A * 1/1998 Lea ..... A47C 27/144 428/158
6,007,667 A * 12/1999 Wang ..... B29D 22/02 156/264
6,108,835 A * 8/2000 Hwang ..... A47C 27/084 5/709
6,287,095 B1 * 9/2001 Saputo ..... A47C 27/084 417/472
6,446,289 B1 * 9/2002 Su ..... A47C 27/18 5/709
11,058,226 B2 * 7/2021 Hsu ..... A47C 27/087
2001/0044969 A1 * 11/2001 Chaffee ..... F04D 29/602 5/655.3
2003/0101516 A1 * 6/2003 Hsu ..... A47C 27/087 5/710

(Continued)

*Primary Examiner* — Myles A Throop
(74) *Attorney, Agent, or Firm* — Hemisphere Law, PLLC; Zhigang Ma

(57) ABSTRACT

An inflatable bed system with automatic rolling up and unfolding includes an inflatable bed and an air pump; the inflatable bed includes an airbag and a sponge liner disposed in the airbag; the airbag is provided with an air port, a side of the sponge liner defines multiple grooves, and the multiple grooves are arranged along a length direction of the sponge liner. When the inflatable bed is folded, the air pump deflates the inflatable bed, and during a deflation process, the inflatable bed is rolled up into a cylindrical shape; when the inflatable bed is unfolded, the air pump inflates the inflate bed, and during an inflation process, the inflatable bed is expanded and unfolded. The inflatable bed system enables automatic rolling up and unfolding of the inflatable bed, saving time and effort, and the volume of the inflatable bed is small after being folded, occupying less space.

7 Claims, 5 Drawing Sheets

(56) References Cited

U.S. PATENT DOCUMENTS

| | | | | |
|---|---|---|---|---|
| 2006/0075569 | A1* | 4/2006 | Giori | A47C 27/15 5/709 |
| 2007/0130693 | A1* | 6/2007 | Theriault | A47G 9/066 5/653 |
| 2008/0289102 | A1* | 11/2008 | Davis | A61G 7/0504 5/81.1 R |
| 2011/0311765 | A1* | 12/2011 | Lincoln | A47C 27/088 428/131 |
| 2019/0008286 | A1* | 1/2019 | Xia | B68G 7/05 |
| 2025/0049224 | A1* | 2/2025 | Zeng | B32B 5/02 |

* cited by examiner

INFLATABLE BED SYSTEM WITH AUTOMATIC ROLLING UP AND UNFOLDING

CROSS-REFERENCE TO RELATED APPLICATIONS

This application claims priority to Chinese Patent Application No. 2024204297092, filed Mar. 6, 2024, which is herein incorporated by reference in its entirety.

This application claims priority to Chinese Patent Application No. 2024225364434, filed Oct. 19, 2024, which is herein incorporated by reference in its entirety.

TECHNICAL FIELD

The disclosure relates to the technical field of inflatable beds, and more particularly to an inflatable bed system with automatic rolling up and unfolding.

BACKGROUND

An inflatable bed has strong flexibility and elasticity, and its expansion volume becomes larger after inflation. Its advantages such as comfort, portability and easy cleaning attract more and more people's preference. Some of the advantages are as follows.

First, compared to a traditional hardboard bed, the air-cushion inflatable bed (i.e., the inflatable bed) can better adapt to human body curves and reduce the generation of pressure points, thereby alleviating body fatigue and discomfort, and providing people with a comfortable sleeping experience.

Second, the air-cushion inflatable bed can be inflated and deflated at any time, making it easy to carry. At home or on a camping trip, the air-cushion inflatable bed can be disposed in living rooms, balconies and other free areas to increase space utilization and also to facilitate the life of users.

Third, the air-cushion inflatable bed can be adjusted according to needs of the users to make spine in a natural state, thus reducing risk of spinal deformity.

However, the air-cushion inflatable bed in the related art is inconvenient to be stored, requiring manual operations, which is time-consuming and laborious. Moreover, when stored, a volume of the air-cushion inflatable bed is not small and occupies a considerable amount of space.

In light of the above, the disclosure provides an inflatable bed system with automatic rolling up and unfolding. It can realize the automatic rolling up and unfolding of a mattress (i.e., the inflatable bed) through an ingenious structural design, which saves time and effort, and has a small volume and occupies a less space after being stored.

SUMMARY

The purpose of the disclosure is to provide an inflatable bed system with automatic rolling up and unfolding. It can realize the automatic rolling up and unfolding of a mattress through an ingenious structural design, which saves time and effort, and has a small volume and occupies less space after being stored.

In order to achieve the above purpose, the disclosure provides the following technical scheme.

An inflatable bed system with automatic rolling up and unfolding includes an inflatable bed and an air pump. The inflatable bed includes an airbag and a sponge liner disposed in the airbag. An air port is disposed on the airbag. A side of the sponge liner defines multiple grooves, and the multiple grooves are arranged along a length direction of the sponge liner;

when the inflatable bed is to be folded, the air pump deflates the inflatable bed, and during the deflation process of the air pump, the inflatable bed is rolled up into a cylindrical shape; and when the inflatable bed is to be unfolded, the air pump inflates the inflatable bed, and during the inflation process of the air pump, the inflatable bed is expanded and unfolded.

In an embodiment, the air pump is an external air pump, and the air port includes an air inlet port and an air outlet port;

when the inflatable bed is to be folded, the air pump is connected to the air outlet port, and during the deflation process of the air pump, the inflatable bed is rolled up into the cylindrical shape; and when the inflatable bed is to be unfolded, the air pump is connected to the air inlet port, and during the inflation process of the air pump, the inflatable bed is expanded and unfolded.

In an embodiment, the air pump is disposed in the airbag.

In an embodiment, a sponge protrusion is formed between every two adjacent grooves of the multiple grooves; and along the length direction of the sponge liner, from a side facing towards the air port to a side facing away from the air port, a ratio of a surface width t1 of the sponge protrusion to a maximum width t2 of one of the multiple grooves adjacent to the sponge protrusion gradually decreases.

In an embodiment, a sponge protrusion is formed between every two adjacent grooves of the multiple grooves; and along the length direction of the sponge liner, from a side facing towards the air port to a side facing away from the air port, the sponge liner includes a first liner section, a second liner section and a third liner section which are integrated into one whole, a ratio of a surface width t1 of the sponge protrusion to a maximum width t2 of one of the multiple grooves adjacent to the sponge protrusion is T, T-t1/t2, a T value of the first liner section is greater than a T value of the second liner section, and the T value of the second liner section is greater than a T value of the third liner section.

In an embodiment, a density of the sponge liner is in a range of 16 kilograms per cubic meter ($kg/m^3$) to 40 $kg/m^3$, a hardness of the sponge liner is in a range of 40 degrees to 75 degrees, and a ratio of a depth of one of the multiple grooves to a total thickness of the sponge liner is in a range of 1/5 to 4/5.

In an embodiment, a shape of the one of the multiple grooves is an inverted trapezoid shape, a U-shape, a V-shape, or a "U" shape (i.e., rectangle).

In an embodiment, when the inflatable bed is to be folded, the sponge liner is rolled up from a side facing away from the air port towards a side facing towards the air port, and an opening direction of each groove is faced inward.

In an embodiment, the air inlet port is provided with an air inlet check value, and the air outlet port is provided with an air outlet check value.

In an embodiment, the air inlet check value is connected to an air pressure regulating value, when the air pressure regulating value is pressed, the air inlet check value is pushed open, and a periphery of the air pressure regulating value is provided with a reset spring.

The disclosure provides another inflatable bed system including: an inflatable bed and an air pump. The inflatable bed includes an airbag and a sponge liner disposed in the airbag. An air port is disposed on the airbag. A side of the sponge liner defines multiple grooves, and the multiple grooves are arranged along a length direction of the sponge liner, and the sponge liner defines at least one through-hole disposed in the multiple grooves;

when the inflatable bed is to be folded, the air pump deflates the inflatable bed, and during the deflation process of the air pump, the inflatable bed is folded into a cylindrical shape; and when the inflatable bed is to be unfolded, the air pump inflates the inflatable bed, and during the inflation process of the air pump, the inflatable bed is expanded and unfolded.

In an embodiment, the at least one through-hole is multiple through-holes which are spaced apart, and cross sections of the multiple through-holes include one or two selected from the group consisting of a circle, an ellipse, and a polygon.

In an embodiment, a sponge protrusion is formed between every two adjacent grooves of the multiple grooves; and along the length direction of the sponge liner, from a side facing towards the air port to a side facing away from the air port, a ratio of a surface width t1 of the sponge protrusion to a maximum width t2 of one of the multiple grooves adjacent to the sponge protrusion gradually decreases.

Compared to the related art, the beneficial effects of the inflatable bed system with automatic rolling up and unfolding provided by the disclosure are: Through an ingenious structural design, that is, the multiple grooves are defined on the side of the sponge liner, when the inflatable bed is to be rolled up for storage, the air pump deflates the inflatable bed, thus air between the sponge liner and the airbag, as well as the air inside the sponge liner and the air in the grooves are evacuated. At this time, the sponge liner is rolled up towards the opening direction of each groove, starting from the side facing away from the air port and rolling up until it reaches a location where the air port is disposed, eventually contracting into a rolled cylindrical state, to achieve automatic rolling up. A shape of the inflatable bed after rolling up is more regular and complete, and the volume is smaller, which is more beneficial to users storing a contracted mattress.

When the inflatable bed is to be used, the air pump inflates the inflatable bed. The air from outside enters the airbag through the air pump, and is gradually filled into a sponge (i.e., the sponge liner) and a space between the sponge and the airbag, which make the interior be gradually saturated. When a required saturation is reached, users can rest on a side facing away from the grooves.

DETAILED DESCRIPTION OF EMBODIMENTS

Figure 1:
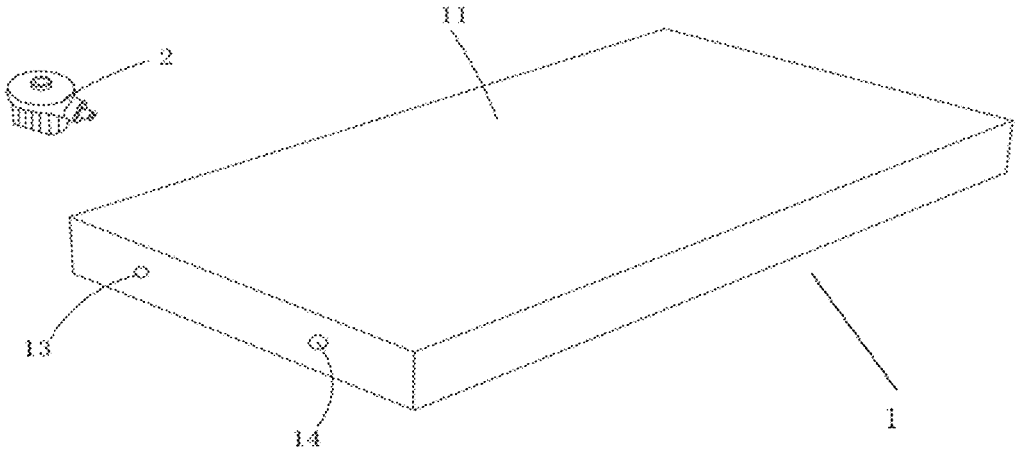
FIG. 1 illustrates an overall schematic structural diagram of an inflatable bed system with automatic rolling up and unfolding according to an embodiment 1 of the disclosure.
Figure 2:
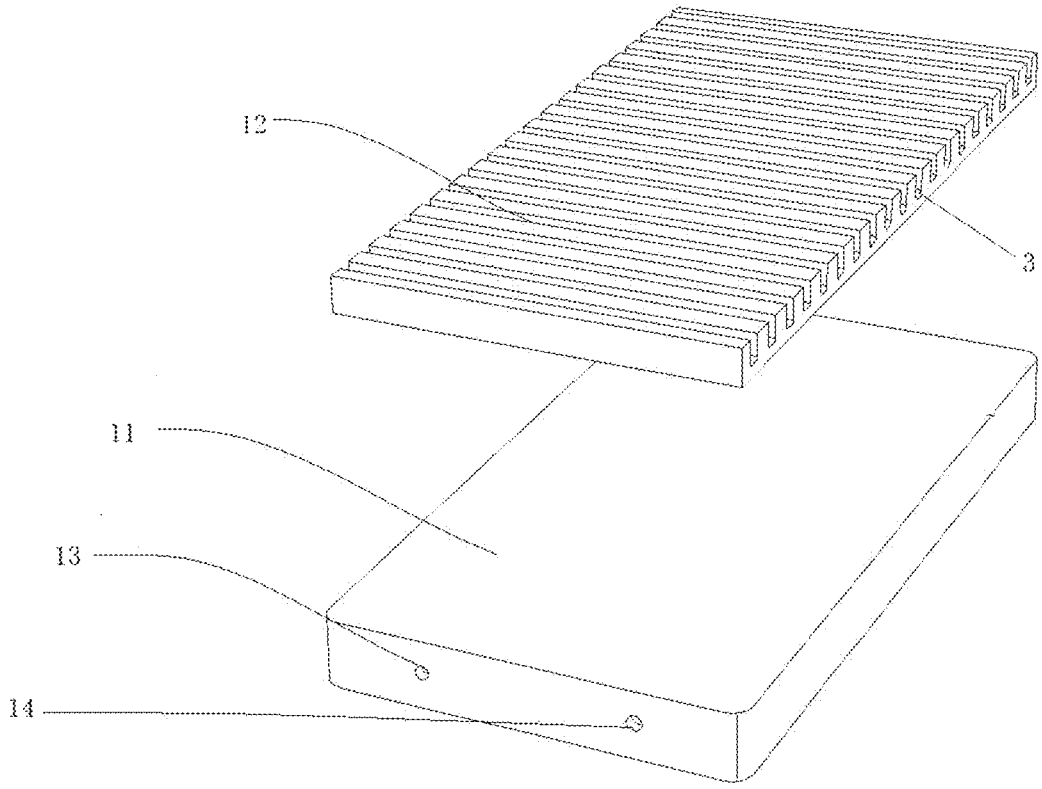
FIG. 2 illustrates an exploded schematic structural diagram of an inflatable bed according to the embodiment 1 of the disclosure.
Figure 3:
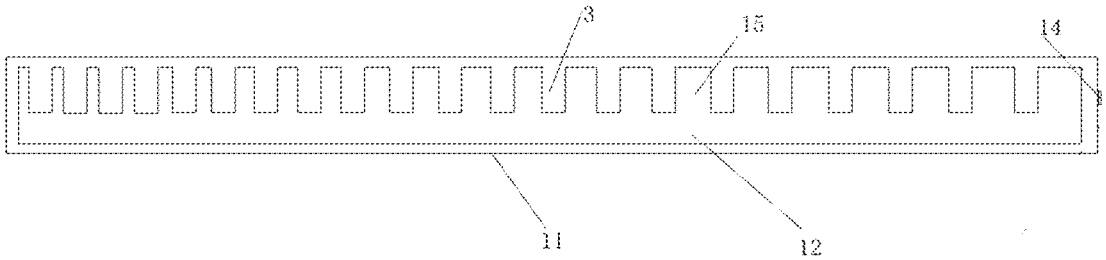
FIG. 3 illustrates an overall structural sectional view of the inflatable bed according to the embodiment 1 of the disclosure.
Figure 4:
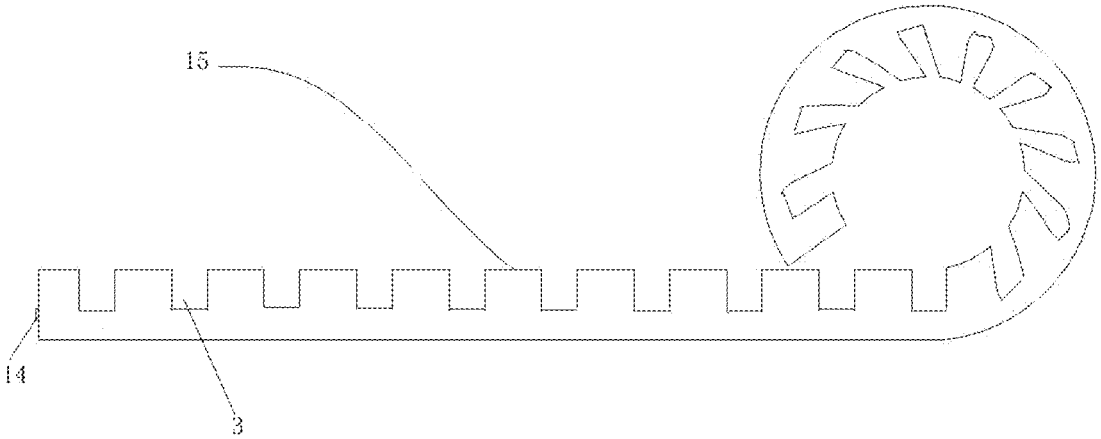
FIG. 4 illustrates a schematic diagram of a rolling up process of the inflatable bed according to the embodiment 1 of the disclosure.
Figure 5:
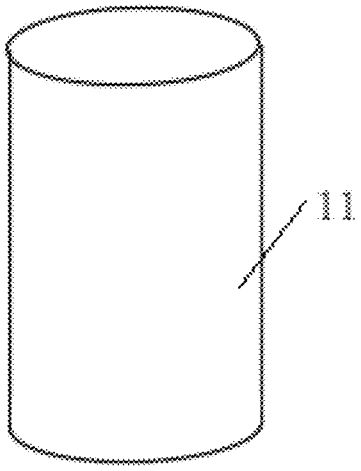
FIG. 5 illustrates a schematic structural diagram of the inflatable bed after rolling up according to the embodiment 1 of the disclosure.

The following will provide a clear and complete description of the technical solution in embodiments of the disclosure, in conjunction with the accompanying drawings. Apparently, the described embodiments are only a part of the embodiments of the disclosure, not all of them. Based on the embodiments in the disclosure, all other embodiments obtained by those skilled in the art without creative labor fall within the scope of protection of the disclosure.

In the description of the disclosure, it should be noted that terms such as "up", "down", "in", "out" "front end", "back end", "two ends", "one side" and "another side" refer to the directions or positional relationships as shown in the accompanying drawings. These terms are used solely for the purpose of describing the disclosure and simplifying the description, and do not indicate or imply that the devices or components referred to must have specific orientations or be constructed and operated in specific directions. Therefore, they should not be understood as limitations on the disclosure. Furthermore, the terms "first" and "second" are used for descriptive purposes only and should not be understood as indicating or implying relative importance.

In the description of the disclosure, it should be noted that unless otherwise specifically defined and limited, terms such as "installed", "provided with" and "connected" should be broadly understood. For example, "connected" can mean a rigid connection, a detachable connection, or being formed as one piece; it can be a mechanical connection or an electrical connection; it can be a direct connection or an indirect connection through an intermediary; it can be an internal connection within two components. For those skilled in the art, the specific meaning of the aforementioned terms in the context of the disclosure can be understood based on the specific circumstances.

Embodiment 1

As shown in FIGS. 1-5, an inflatable bed system with automatic rolling up and unfolding includes an inflatable bed 1 and an air pump 2. The inflatable bed 1 includes an airbag 11 and a sponge liner 12 disposed in the airbag 11. The airbag 11 is provided with an air inlet port 13 and an air outlet port 14. A side of the sponge liner 12 defines multiple grooves 3, and the multiple grooves 3 are arranged along a length direction of the sponge liner 12. The air inlet port 13 and the air outlet port 14 can be disposed at a same end or different ends of the airbag 11.

When the inflatable bed 1 is to be rolled up, that is, the inflatable bed 1 is to be folded or stored, the air pump 2 is connected to the air outlet port 14, and during a deflation process of the air pump 2, the inflatable bed 1 is rolled up into a cylindrical shape.

When the inflatable bed 1 is to be unfolded, the air pump 2 is connected to the air inlet port 13, and during an inflation process of the air pump 2, the inflatable bed 1 is expanded and unfolded.

A sponge protrusion 15 is formed between every two adjacent grooves 3, and along the length direction of the sponge liner 12, from a side where the air outlet port 14 is disposed to a side facing away from the air outlet port 14, a ratio of a surface width t1 of the sponge protrusion 15 to a maximum width t2 of the groove 3 adjacent to the sponge protrusion 15 gradually decreases. This ingenious structural design makes the inflatable bed 1 be rolled up to a tail at one time conveniently and smoothly even if a lithium battery air pump (with limited air pump power) is used outdoors. Because this structure helps sponge resistance to compress step by step, allowing the sponge liner 12 to be rolled up smoothly from the side facing away from the air outlet port 14 to the side where the air outlet port 14 is disposed at one time, without pausing halfway. The inflatable bed in the related art cannot achieve such an effect when using a small power air pump outdoors, and only be rolled up manually, which is not only time-consuming and laborious but also results in a larger volume after rolling up, leading to poor storability and portability.

A density of the sponge liner 12 is preferably in a range of 16 kg/m$^3$ to 40 kg/m$^3$. This is because if the density is too low, the sponge will be too soft and unable to be rolled up smoothly; if the density is too high, a cylindrical volume after rolling up will be too large, with poor compression effect, which fails to achieve better portability and storability.

A hardness of the sponge liner 12 is in a range of 40 degrees to 75 degrees. If the hardness is too low, the sponge will be too soft and unable to be rolled up smoothly; if the hardness is too high, it will be difficult to compress, resulting in the larger cylindrical volume after rolling up, which fails to achieve better portability and storability.

A ratio of a depth of the groove 3 to a total thickness of the sponge liner 12 is in a range of 1/5 to 4/5. If the depth of the groove 3 is too small, it will be impossible to be rolled up. If the depth of the groove 3 is too large, it will reduce a support effect of the inflatable bed 1, thereby affecting the comfort and service life of the inflatable bed 1.

The groove 3 is shaped as an inverted trapezoid shape, a U-shape, a V-shape, or a "L" shape (i.e., rectangle), and the "L" shape is preferred in the embodiment. The sponge liner 2 of this structure not only has a good rolling effect but also saves production material costs due to the interlocking cutting.

When the inflatable bed 1 is to be rolled up, the sponge liner 12 is rolled up from the side facing away from the air outlet port 14 towards the side where the air inlet port 14 is disposed, and an opening direction of each groove 3 is faced inward.

The air inlet port 13 is provided with an air inlet check value, and through the air inlet check value, air can only enter and not exit. The air outlet port 14 is provided with an air outlet check value, and through the air outlet check value, the air can only enter and not exit.

The air inlet check value is connected to an air pressure regulating value (also referred to an air pressure regulator), and when the air pressure regulating value is pressed, the air inlet check value is pushed open. At this time, some of the air inside an inflatable product (i.e., the inflatable bed) is released. A periphery of the air pressure regulating value is provided with a reset spring, when it is no longer necessary to release air, stop pressing the air pressure regulating value, and the air pressure regulating value will return to its original position under an action of the reset spring. The design of the structure can adjust an amount of air inside the inflatable bed 1, thereby adjusting the softness and firmness of its surface support. Users can adjust it according to their preferred level of softness comfort.

Compared to the related art, the beneficial effects of the inflatable bed system with automatic rolling up and unfolding provided by the disclosure are: Through an ingenious structural design, that is, the multiple grooves 3 are defined on the side of the sponge liner 12, when the inflatable bed 1 is to be rolled up for storage, the air pump 2 deflates the inflatable bed 1, thus the air between the sponge liner 12 and the airbag 11, as well as the air inside the sponge liner 12 and the air in the grooves 3 are evacuated. At this time, the sponge liner 12 is rolled up towards the opening direction of each groove 3, starting from the side facing away from the air outlet port 14 and rolling up until it reaches a location where the air outlet port 14 is disposed, eventually contracting into a rolled cylindrical state, to achieve automatic rolling up. A shape of the inflatable bed 1 after rolling up is more regular and complete, and the volume is smaller, which is more beneficial to users storing a contracted mattress.

When the inflatable bed 1 is used, the air pump 2 inflates the inflatable bed 1. The air from outside enters the airbag 11 through the air pump 2, and is gradually filled into the sponge liner 12 and a space between the sponge liner 12 and the airbag 11, which make the interior be gradually saturated. When a required saturation is reached, users can rest on a side facing away from the grooves 3.

Embodiment 2

Figure 6:
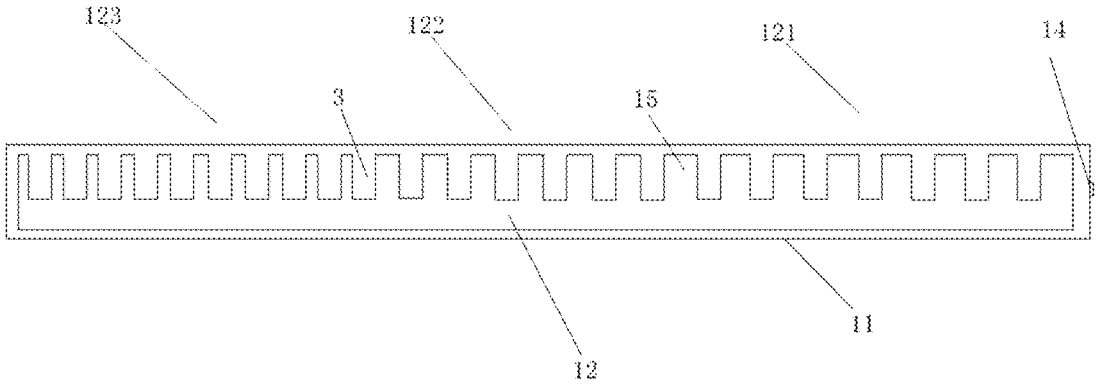
FIG. 6 illustrates an overall structural sectional view of an inflatable bed according to an embodiment 2 of the disclosure.

As shown in FIG. 6, different from the embodiment 1, the sponge protrusion 15 is formed between every two adjacent grooves 3; and along the length direction of the sponge liner 12, from the side where the air outlet port 14 is disposed to the side facing away from the air outlet port 14, the sponge liner 12 includes a first liner section 121, a second liner section 122 and a third liner section 123 which are integrally into one whole, the ratio of the surface width t1 of the sponge protrusion 15 to the maximum width t2 of the groove 3 adjacent to the sponge protrusion 15 is T, T=t1/t2, a T value of the first liner section 121 is greater than a T value of the second liner section 122, and the T value of the second liner section 122 is greater than a T value of the third liner section 123. The advantage of this structure is that the effects of the aforementioned structure not only can be achieved, but also the three-sectional structure facilitates production process and reduces production costs.

Of course, according to needs, the sponge liner 12 can be set as two-section, four-section, five-section and so on.

The rest is the same as the embodiment 1, and will not be repeated here.

Embodiment 3

Figure 7:
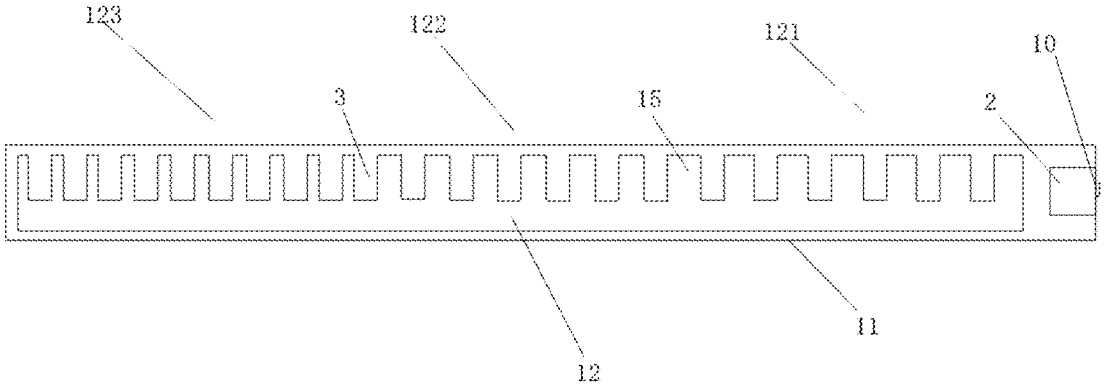
FIG. 7 illustrates an overall structural sectional view of an inflatable bed system according to an embodiment 3 of the disclosure.

As shown in FIG. 7, different from the embodiment 2, the air pump 2 is disposed in the airbag 11, forming an integrated structure, and the air pump 2 is provided with a stop button, an inflation button, and a deflation button (or other similar switches, voice control units, or any other devices that can perform functions of starting inflation, deflation, and stopping inflation/deflation).

When the inflatable bed 1 is to be rolled up, pressing the deflation button, and the air pump 2 deflates the inflatable bed 1. During the deflation process of the air pump 2, the inflatable bed 1 is rolled up into the cylindrical shape.

When the inflatable bed 1 is to be unfolded, pressing the inflation button, and the air pump 2 inflates the inflatable bed 1. During the inflation process of the air pump 2, the inflatable bed 1 is expanded and unfolded.

The sponge protrusion 15 is formed between every two adjacent grooves 3, and along the length direction of the sponge liner 12, from the side where the air port 10 is disposed to the side facing away from the air port 10, the ratio of the surface width t1 of the sponge protrusion 15 to the maximum width t2 of the groove 3 adjacent to the sponge protrusion 15 gradually decreases.

The rest is the same as the embodiment 2, and will not be repeated here.

Embodiment 4

Figure 8:
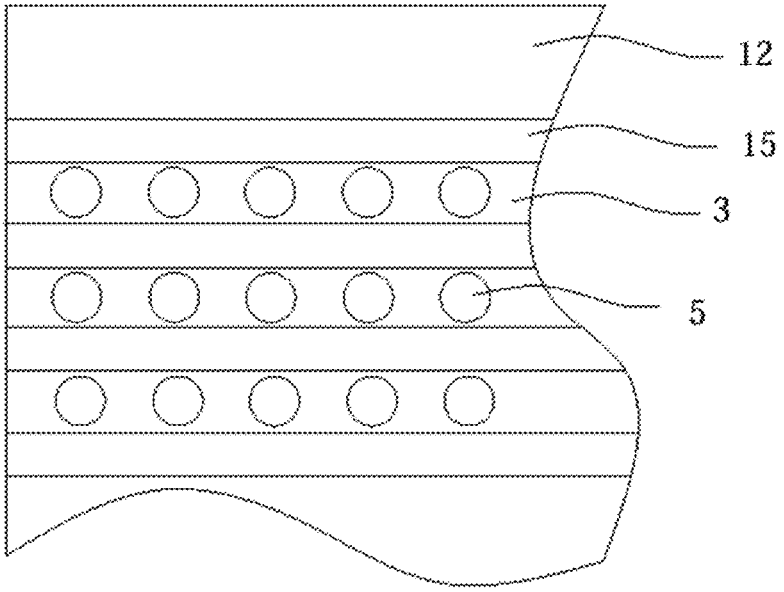
FIG. 8 illustrates a partial structural top view of an inflatable bed according to an embodiment 4 of the disclosure.

As shown in FIGS. 1 and 8, the inflatable bed system includes the inflatable bed 1 and the air pump 2. The inflatable bed 1 includes the airbag 11 and the sponge liner 12 disposed in the airbag 11. The airbag 11 is provided with the air inlet port 13 and the air outlet port 14. The side of the sponge liner 12 defines the multiple grooves 3, and the multiple grooves 3 are arranged along the length direction of the sponge liner 12. The air inlet port 13 and the air outlet port 14 can be disposed at the same end or the different ends of the airbag 11. The sponge liner 12 defines at least one through-hole disposed in the grooves 3.

When the inflatable bed 1 is to be rolled up, the air pump 2 is connected to the air outlet port 14, and during the deflation process of the air pump 2, the inflatable bed 1 is rolled up into the cylindrical shape.

When the inflatable bed 1 is to be unfolded, the air pump 2 is connected to the air inlet port 13, and during the inflation process of the air pump 2, the inflatable bed 1 is expanded and unfolded.

Figure 9:
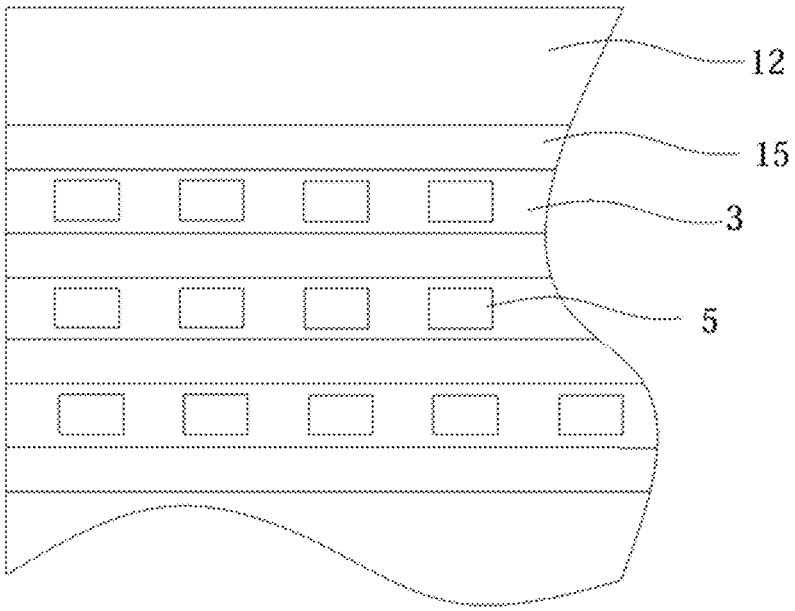
FIG. 9 illustrates another partial structural top view of an inflatable bed according to the embodiment 4 of the disclosure.
Figure 10:
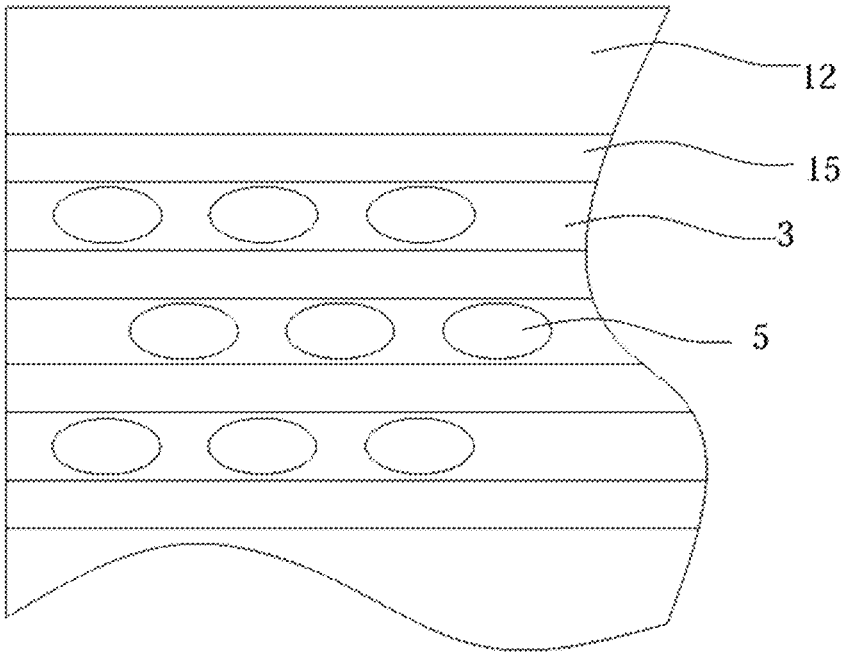
FIG. 10 illustrates yet another partial structural top view of an inflatable bed according to the embodiment 4 of the disclosure.

The through-hole 5 is multiple and the multiple through-holes 5 are spaced apart, and cross sections of the multiple through-holes 5 include one or two selected from the group consisting of a circle, an ellipse, and a polygon, for example, refer to FIGS. 9 and 10.

The sponge protrusion 15 is formed between every two adjacent grooves 3, along the length direction of the sponge liner 12, from the side where the air outlet port 14 is disposed to the side facing away from the air outlet port 14. since through-holes 5 are disposed in the grooves 3, when the inflatable bed 1 is to be deflated, adjacent sponge protrusions 15 approach and compress each other, causing the through-holes 5 to deform to make a bottom of the groove 3 gradually narrow, which makes the sponge protrusions 15 contract like an accordion. When the inflatable bed 1 is to be inflated, the through-holes 5 gradually return to their original shape, causing the bottom of the groove 3 to gradually widen, and the adjacent sponge protrusions 15 move apart from each other, which makes the sponge protrusions 15 expand like the accordion.

The rest is the same as the embodiment 3, and will not be repeated here.

Finally, it should be noted that the above descriptions are merely preferred embodiments of the disclosure and are not intended to limit the disclosure. Although the disclosure has been described in detail with reference to the aforementioned embodiments, those skilled in the art can still modify the technical solutions recorded in the aforementioned embodiments or replace some technical features with equivalent ones. Any modifications, equivalent substitutions, improvements, etc., made within the spirit and principles of the disclosure should be included within the scope of protection of the disclosure.

What is claimed is:

1. An inflatable bed system, comprising:

an air pump; and an inflatable bed, wherein the inflatable bed comprises:

an airbag, wherein an air port is disposed on the airbag; and a sponge liner, disposed in the airbag, wherein a side of the sponge liner defines a plurality of grooves, and the plurality of grooves are arranged along a length direction of the sponge liner;

wherein when the inflatable bed is to be folded, the air pump deflates the inflatable bed, and during the deflation process of the air pump, the inflatable bed is folded into a cylindrical shape;

wherein when the inflatable bed is to be unfolded, the air pump inflates the inflatable bed, and during the inflation process of the air pump, the inflatable bed is expanded and unfolded;

wherein a sponge protrusion is formed between every two adjacent grooves of the plurality of grooves; and along the length direction of the sponge liner, from a side facing towards the air port to a side facing away from the air port, a ratio of a surface width t1 of the sponge protrusion to a maximum width t2 of one of the plurality of grooves adjacent to the sponge protrusion gradually decreases; or wherein a sponge protrusion is formed between every two adjacent grooves of the plurality grooves;

and along the length direction of the sponge liner, from a side facing towards the air port to a side facing away from the air port, the sponge liner comprises a first liner section, a second liner section and a third liner section which are integrated into one whole, a ratio of a surface width t1 of the sponge protrusion to a maximum width t2 of one of the plurality of grooves adjacent to the sponge protrusion is T, T=t1/t2, a T value of the first liner section is greater than a T value of the second liner section, and the T value of the second liner section is greater than a T value of the third liner section.

2. The inflatable bed system as claimed in claim 1, wherein the air pump is an external air pump, and the air port comprises an air inlet port and an air outlet port;

wherein when the inflatable bed is to be folded, the air pump is connected to the air outlet port, and during the deflation process of the air pump, the inflatable bed is rolled up into the cylindrical shape;

wherein when the inflatable bed is to be unfolded, the air pump is connected to the air inlet port, and during the inflation process of the air pump, the inflatable bed is expanded and unfolded.

3. The inflatable bed system as claimed in claim 1, wherein the air pump is disposed in the airbag.

4. The inflatable bed system as claimed in claim 1, wherein a shape of one of the plurality grooves is an inverted trapezoid shape, a U-shape, a V-shape, or a rectangle.

5. The inflatable bed system as claimed in claim 1, wherein when the inflatable bed is to be folded, the sponge liner is rolled up from a side facing away from the air port towards a side facing towards the air port, and an opening direction of each groove is faced inward.

6. An inflatable bed system, comprising:

an air pump; and an inflatable bed, wherein the inflatable bed comprises:

an airbag, wherein an air port is disposed on the airbag; and a sponge liner, disposed in the airbag, wherein a side of the sponge liner defines a plurality of grooves, the plurality of grooves are arranged along a length direction of the sponge liner, and the sponge liner defines at least one through-hole disposed in the plurality of grooves;

wherein when the inflatable bed is to be folded, the air pump deflates the inflatable bed, and during the deflation process of the air pump, the inflatable bed is folded into a cylindrical shape;

wherein when the inflatable bed is to be unfolded, the air pump inflates the inflatable bed, and during the inflation process of the air pump, the inflatable bed is expanded and unfolded; and wherein a sponge protrusion is formed between every two adjacent grooves of the plurality of grooves; and along the length direction of the sponge liner, from a side facing towards the air port to a side facing away from the air port, a ratio of a surface width t1 of the sponge protrusion to a maximum width t2 of one of the plurality grooves adjacent to the sponge protrusion gradually decreases.

7. The inflatable bed system as claimed in claim 6, wherein the at least one through-hole is multiple through-holes which are spaced apart, and cross sections of the multiple through-holes comprise one or two selected from the group consisting of a circle, an ellipse, and a polygon.

* * * * *